US007450082B1

(12) United States Patent
Lopez

(10) Patent No.: US 7,450,082 B1
(45) Date of Patent: Nov. 11, 2008

(54) SMALL TUNED-ELEMENT GPS ANTENNAS FOR ANTI-JAM ADAPTIVE PROCESSING

(75) Inventor: Alfred R. Lopez, Commack, NY (US)

(73) Assignee: BAE Systems Information And Electronics Systems Integration Inc., Nashua, NH (US)

( * ) Notice: Subject to any disclaimer, the term of this patent is extended or adjusted under 35 U.S.C. 154(b) by 0 days.

(21) Appl. No.: 11/395,495

(22) Filed: Mar. 31, 2006

(51) Int. Cl.
*H01Q 1/50* (2006.01)
*H01Q 21/00* (2006.01)

(52) U.S. Cl. ..... 343/850; 343/853; 343/844

(58) Field of Classification Search ..... 343/850, 343/851, 852, 853, 855, 856, 857, 858, 859, 343/860, 861, 862, 749, 750, 751, 752, 844
See application file for complete search history.

(56) References Cited

U.S. PATENT DOCUMENTS 3,811,127 A 5/1974 Griffee et al. ..... 343/705
5,006,859 A * 4/1991 Wong et al. ..... 343/700 MS
5,521,610 A 5/1996 Rodal ..... 343/797
5,966,102 A 10/1999 Runyon ..... 343/820
6,618,016 B1 9/2003 Hannan et al. ..... 343/705
6,819,291 B1 11/2004 Lackey et al. ..... 373/700

OTHER PUBLICATIONS

Microwave Scanning Antennas, R. C. Hansen, Academic Press, 1966, p. 261.

* cited by examiner

*Primary Examiner*—Hoang V Nguyen
*Assistant Examiner*—Robert Karacsony
(74) *Attorney, Agent, or Firm*—Kenneth P. Robinson

(57) ABSTRACT

A GPS antenna with anti-jam capabilities utilizes eight resonant loop radiator elements in a resonant exciter configuration to make available a primary and up to seven auxiliary antenna patterns usable with multi-pattern adaptive processing for anti-jam operation. Antennas as described enable desired radiation characteristics to be provided in a configuration of small size suitable for replacement of existing GPS aircraft antennas which lack anti-jam capabilities, in order to enable reliable GPS reception during airborne operations in the presence of interference or jamming. With enablement of multi-pattern adaptive processing, reduced-gain pattern notches or nulls may be employed to track and reduce the effect of incident signals which would otherwise jam or interfere with reception of GPS signals.

14 Claims, 8 Drawing Sheets

| MODE | PHASE EXCITATION (DEGREES) ELEMENT NUMBER | | | | | | | |
|---|---|---|---|---|---|---|---|---|
| | 1 | 2 | 3 | 4 | 5 | 6 | 7 | 8 |
| I | 0 | 45 | 90 | 135 | 180 | 225 | 270 | 315 |
| II | 0 | -45 | -90 | -135 | -180 | -225 | -270 | -315 |
| III | 0 | 90 | 180 | 270 | 0 | 90 | 180 | 270 |
| IV | 0 | -90 | -180 | -270 | 0 | -90 | -180 | -270 |
| V | 0 | 135 | 270 | 45 | 180 | 315 | 90 | 225 |
| VI | 0 | -135 | -270 | -45 | -180 | -315 | -90 | -225 |
| VII | 0 | 180 | 0 | 180 | 0 | 180 | 0 | 180 |
| VIII | 0 | 0 | 0 | 0 | 0 | 0 | 0 | 0 |

| MODE | 1228 MHz | | | 1575 MHz | | |
|---|---|---|---|---|---|---|
| | Gain (dBiRHCP) | Reflection Loss (dB) | Realized Gain (dBiRHCP) | Gain (dBiRHCP) | Reflection Loss (dB) | Realized Gain (dBiRHCP) |
| Ref (45°) | 0.3 | -0.1 | 0.2 | 0.8 | -0.1 | 0.7 |
| UPO (0°) | 1.4 | -10.0 | -8.6 | 2.0 | -6.5 | -4.5 |
| 90° | 0.6 | -7.9 | -7.3 | 1.2 | -3.8 | -2.6 |
| 135° | -8.6 | -15.6 | -24.2 | -2.2 | -13.5 | -15.7 |

SMALL TUNED-ELEMENT GPS ANTENNAS FOR ANTI-JAM ADAPTIVE PROCESSING

RELATED APPLICATIONS (Not Applicable)

FEDERALLY SPONSORED RESEARCH (Not Applicable)

BACKGROUND OF THE INVENTION

This invention relates to airborne antennas and, more particularly, to such antennas providing multiple beam excitation usable with anti-jam adaptive processing to suppress jamming and interference.

A variety of antennas have been made available for reception of Global Positioning System (GPS) signals for navigational and other purposes. A more critical objective than the mere capability to receive such signals, is the objective of enabling reception in the presence of interference or jamming signals. Interference may be the unintended result of reception of signals radiated for some purpose unrelated to GPS operations. Jamming, on the other hand, may involve signals intentionally transmitted for the purpose of obstructing reception of GPS signals. In airborne operations which are dependent upon use of GPS signals, deleterious effects of interference or jamming may be particularly disruptive.

For reception via a fixed-position antenna in the presence of interference signals incident from a fixed azimuth, for example, a reduced-gain antenna pattern notch aligned to suppress reception at the appropriate azimuth may be employed as an effective solution. However, for airborne operations a more complex solution is required. With an aircraft and its antenna operable in a variety of geographical locations and conditions, with constantly changing azimuth orientation during flight, interference or jamming signals may be incident from any azimuth and with constantly changing azimuth. At the same time, maneuvers such as banked turns of an aircraft, for example, tilt the aircraft and its antenna so that the interference or jamming signals may be incident from different and changing elevation angles.

A variety of adaptive processing techniques have previously been described. Such techniques typically provide an anti-jam capability based on provision of reduced-gain antenna pattern notches and alignment of such notches at the incident azimuth of undesired incoming signals. However, to enable practical employment of such techniques for reception of GPS signals under critical airborne operations, reliable, low-profile antennas providing a multi-beam capability suitable for anti-jam application are required.

Size constraints regarding aircraft antennas may limit the implementation of anti-jam techniques in the context of aircraft-mounted GPS antennas. For example, at present many military aircraft are equipped with a fixed radiation pattern antenna ("FRPA") for GPS operation. This small size antenna (i.e., active antenna volume in inches of 3.73×3.73×0.86 height, within a radome) provides no multi-pattern capability to support adaptive processing for anti-jam operation. Available antennas generally do not enable such adaptive processing capabilities to be implemented in an antenna of that size.

Examples of prior antennas providing anti-jam capabilities in the context of airborne GPS antennas are provided in U.S. Pat. Nos. 6,618,016 and 6,819,291, having a common assignee with the present application. The former patent describes, in particular, GPS antennas including four bent monopoles in combination with four slot elements to provide primary and auxiliary antenna patterns usable for aircraft anti-jam applications. The latter patent describes, in particular, GPS antennas including a circular array of eight monopole elements arranged to provide anti-jam capabilities.

Airborne applications may include large aircraft, smaller fighter and drone aircraft where small antenna size is important, and smaller objects such as missiles, guided bombs and other projectiles. In the latter categories of applications size, weight, cost and complexity become increasingly important, along with antenna anti-jam operational capabilities. For such applications, it is desirable to provide smaller antennas able to meet overall objectives of small size and low weight, cost and complexity, with concurrent high performance and the capability of providing multiple auxiliary antenna patterns usable for anti-jam adaptive processing for such applications.

Accordingly, objects of the present invention are to provide new and improved GPS antennas, and antennas which may have one or more of the following characteristics and capabilities:

effective basic GPS reception;

anti-jam capabilities;

GPS plus anti-jam in small configuration;

omnidirectional hemispherical primary coverage;

up to seven selectively usable auxiliary radiation patterns;

multiple pattern excitation suitable for adaptive processing anti-jam operation;

tuned elements capable of very small size implementation;

low cost, high reliability implementation; and small size, low profile configuration suitable for replacement of GPS aircraft antennas lacking anti-jam features.

SUMMARY OF THE INVENTION

In accordance with one embodiment of the invention, a GPS antenna, usable for anti-jam operation, may include a ground plane portion having a central axis and an outer periphery, an excitation network and a plurality of radiating elements arrayed around the central axis. Each radiating element may comprise:

a radiator portion extending above the ground plane portion from an outer location above the outer periphery toward the central axis and including a section extending upward from the periphery to the outer location;

a first capacitor portion capacitively coupled to the radiator portion and conductively coupled to the ground plane portion;

an exciter portion extending below the radiator portion from a position above the outer periphery toward the central axis and coupled to the excitation network; and a second capacitor portion capacitively coupled to the exciter portion and conductively coupled to the ground plane section.

The GPS antenna may additionally include a central disk centered at the central axis, extending above the ground plane portion toward the first capacitor portion and conductively coupled to the ground plane portion.

In GPS antennas pursuant to the invention, the excitation network may be configured to provide output signals representative of each of the following antenna patterns;

(i) 45 degree counter-clockwise (CCW) progressive phase excitation of the radiating elements to produce a first circularly-polarized omnidirectional antenna pattern;

(ii) 45 degree clockwise (CW) progressive phase excitation of the radiating elements to produce a second circularly polarized omnidirectional antenna pattern;

(iii) 90 degree CCW progressive phase (PP) excitation of the radiating elements to produce a 90 degree CCW PP antenna pattern;

(iv) 90 degree CW progressive phase excitation of the radiating elements to produce a 90 degree CW PP antenna pattern;

(v) 135 degree CCW progressive phase excitation of the radiating elements to produce a 135 degree CCW PP antenna pattern;

(vi) 135 degree CW progressive phase excitation of the radiating elements to produce a 135 degree CW PP antenna pattern;

(vii) 180 degree progressive phase excitation of the radiating elements to produce an eight-lobe antenna pattern; and (viii) same phase excitation of the radiating elements to produce a uniform phase omnidirectional antenna pattern.

In other embodiments, antennas may be arranged to utilize only some of the above antenna patterns in different selected combinations.

In accordance with another embodiment, an antenna may include a ground plane portion having a central axis and an outer periphery, an excitation port and at least one radiating element. The radiating element may include a radiator portion extending above the ground plane portion from an outer location above the outer periphery toward the central axis and an exciter portion extending below the radiator portion from a position above the periphery toward the central axis and coupled to the excitation port.

For a better understanding of the invention, together with other and further objects, reference is made to the accompanying drawings and the scope of the invention will be pointed out in the accompanying claims.

DESCRIPTION OF THE INVENTION

Figure 1:
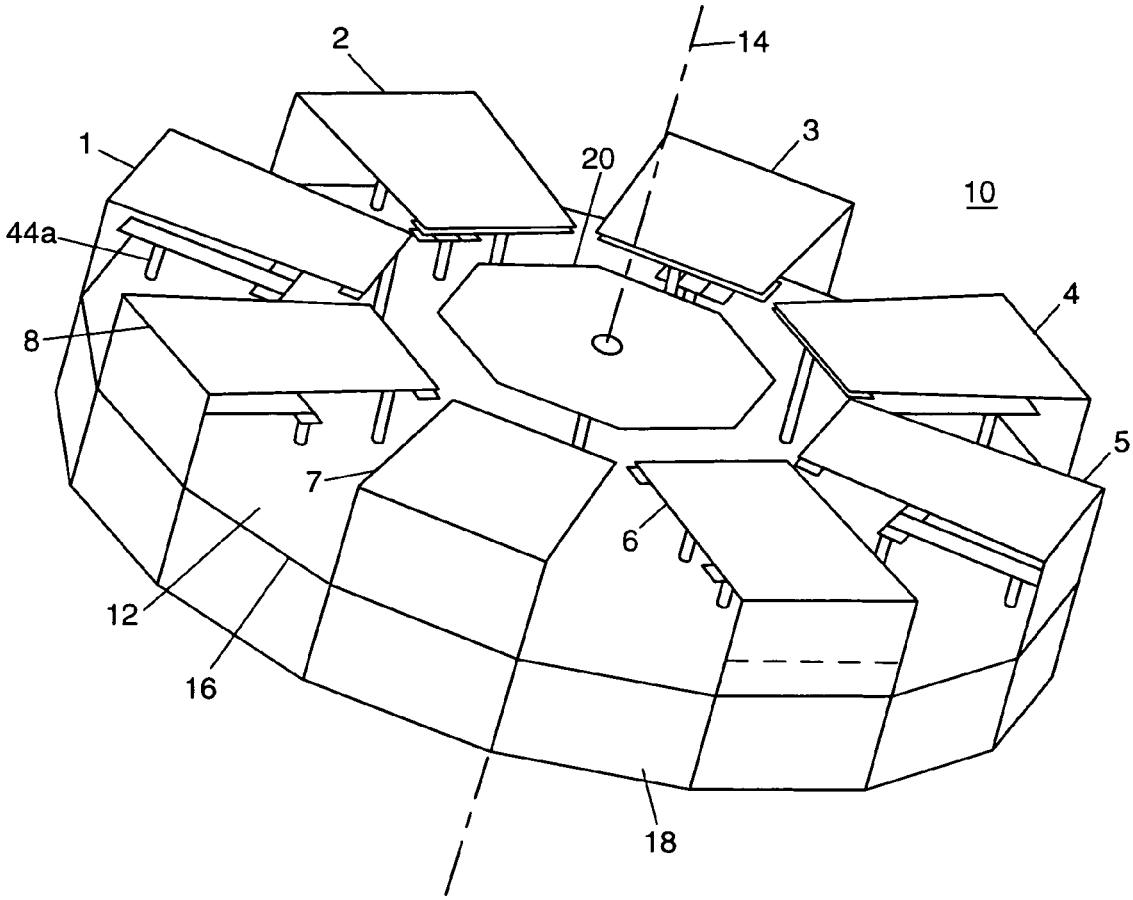
FIG. 1 is a three-dimensional view of an embodiment of an eight element GPS antenna.

FIG. 1 is a three-dimensional view of a GPS antenna 10 usable for anti-jam operation. As shown, antenna 10 includes eight radiating elements 1-8, which may be arranged for multi-pattern adaptive processing for anti-jam operation. For dual-band GPS reception, with anti-jam processing for critical airborne applications, the FIG. 1 antenna may include radiating elements having a vertical dimension of only about 0.375 inch above a base enclosure, in an array antenna with overall dimensions of approximately 3.6 inches in diameter by approximately 0.75 inch in height. As will be described, this antenna can be arranged to provide a principal hemispherical, omnidirectional circularly-polarized antenna pattern, with up to seven additional auxiliary patterns having differing characteristics usable for multi-pattern adaptive processing. An excitation network may be positioned within the lower enclosure.

The FIG. 1 antenna includes a ground plane portion 12 having a central axis 14 and an outer periphery 16, which is a 16-sided polygon in this example. Ground plane portion 12 may be formed of metal, such as thin aluminum, of a composite with a conductive upper surface, or be of any suitable form or construction to provide a ground plane function in known manner. In this embodiment, there is included a lower 16-sided cylindrical structure 18 extending downward from outer periphery 16 of the ground plane portion. Structure 18 may enclose an excitation network, such as a Butler type beam forming network, arranged for coupling to the radiating elements, as will be further described with reference to network 50 of FIG. 4. FIG. 1 is a three-dimensional type of presentation wherein central axis 14 is shown tilted, whereas in typical use axis 14 may have a nominally vertical orientation. For clarity of presentation, various parts of the FIG. 1 antenna are shown without representation of the thickness they will have in a physical implementation.

Figure 2:
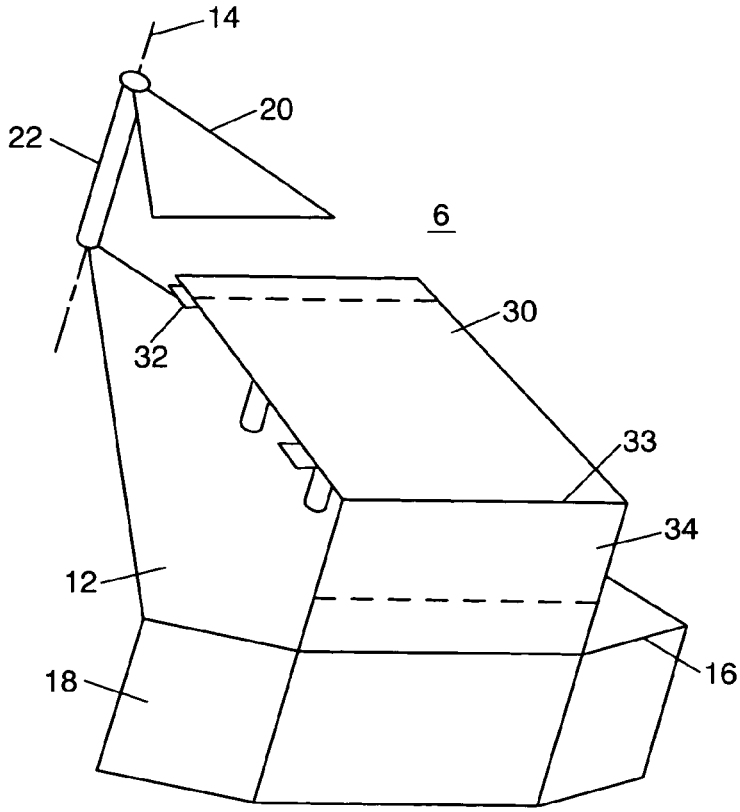
FIG. 2 is a corresponding view showing a one-radiating-element sector of the FIG. 1 antenna.
Figure 3:
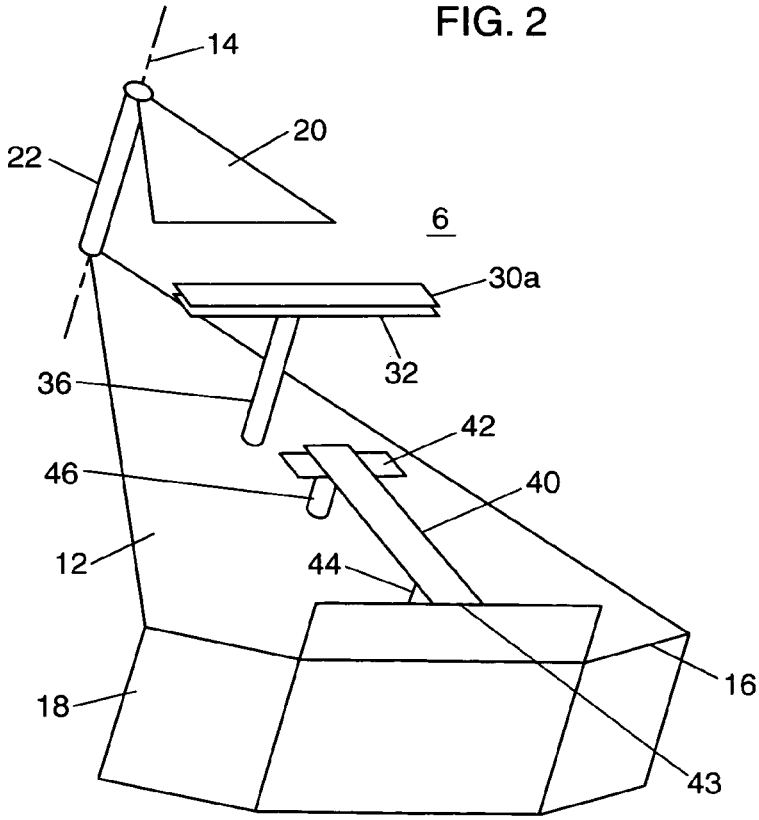
FIG. 3 is a version of FIG. 2 with portions removed as an aid to description.

In FIG. 1, antenna 10 includes a plurality of radiating elements arrayed around central axis 14. In this example, the antenna includes eight radiating elements 1, 2, 3, 4, 5, 6, 7, 8, each of which comprises a radiator portion and an underlying exciter portion. A centrally positioned disk 20 is also included. Reference is now made to FIGS. 2 and 3, which show only a one-eighth or 45° section of the FIG. 1 antenna with the rest of the FIG. 1 antenna separated away. In FIG. 2 the radiating element 6 of the FIG. 1 antenna is presented in the same manner as in FIG. 1 and FIG. 3 shows the structure of FIG. 2 with portions removed for greater visibility for purposes of description. It will be appreciated that ground plane portion 12 and other portions of the antenna may be of unitary or other construction and not readily separated as in FIGS. 2 and 3, which are presented for purposes of illustration and description.

More particularly, radiating element 6 (which is typical of the other seven radiating elements of FIG. 1) comprises a radiator portion 30, shown with an associated first capacitor portion 32, and an exciter portion 40, shown with an associated second capacitor portion 42.

In FIGS. 2 and 3, it will be seen that radiator portion 30 extends above the ground plane portion 12 nominally horizontally from an outer location 33 above the periphery 16 toward central axis 14. As shown, the radiator portion 30 includes a section 34 extending upward from periphery 16 to outer location 33. The first capacitor portion 32 is shown positioned below the end of radiator portion 30 (i.e., below end part 30*a* as shown in FIG. 3) and is capacitively coupled to the radiator portion and conductively coupled to ground plane portion 12, via vertical member 36. Member 36 may be a rod, conductor or other device of any construction suitable to provide a conductive path and some degree of support of capacitor portion 32 above ground plane portion 12.

Exciter portion 40, as more clearly shown in FIG. 3, extends below radiator portion 30 from a position 43 above periphery 16 toward central axis 14. As will be described further with reference to FIG. 4, exciter portion 40 is coupled to the excitation network 50 located below ground plane section 12. Such coupling may be provided via vertical member 44, which is more clearly visible by reference to corresponding member 44*a* of radiating element 1 in FIG. 1. The second capacitor portion 42 is shown positioned below the end of exciter portion 40 and is capacitively coupled to the exciter portion and conductively coupled to ground plane portion 12, via vertical member 46. Members 44 and 46 may be of any suitable construction as discussed above with reference to member 36, except that vertical member 44 is electrically isolated from ground plane portion 12 and is arranged to provide a coupling between exciter portion 40 and the excitation network 50 below the ground plane portion.

As shown and described, the first and second capacitor portions 32 and 42 may each take the form of a conductive plate, sheet or surface in parallel spaced relation below the innermost parts of the respective radiator and exciter portions 30 and 40 (i.e., part 30*a* of radiator portion 30). In this configuration, a capacitive value is provided by the spaced conductive surfaces, between which may be included a suitable dielectric material such as air, dielectric foam or a higher dielectric constant material, as may be determined by skilled persons for specific implementations. In other embodiments any suitable form and construction of capacitor devices may be utilized. Functionally, the capacitor portions 32 and 42 are configured to provide impedance matching (e.g., tuning) of the respective radiator and exciter portions for operation in GPS frequency bands, as will be further described.

As also shown in FIGS. 2 and 3, disk 20 is conductively coupled to the ground plane portion 12 via vertical member 22, which may be of any suitable construction as discussed with reference to member 36. In particular embodiments, disk 20 may be employed as a capacitive tuning element to adjust performance of a uniform phase omnidirectional antenna pattern (e.g., Mode VIII referred to below). Structural stability for the form of construction of FIG. 1 may be provided by inclusion of suitably formed pieces of low dielectric constant foam or other suitable devices or arrangements provided to support the antenna components.

On an overview basis, eight identical radiating elements are provided in the FIG. 1 antenna in this embodiment. These radiating elements include radiator portions which are physically of rectangular form extending nominally horizontally over the ground plane surface and are arranged for excitation via underlying exciter portions. In this arrangement, signals provided from the excitation network 50 of FIG. 4 to the exciter portions are magnetically coupled to the radiator portions. As described, in this configuration each radiating element includes a vertically extending section (e.g., section 34) coupled to a portion of the 16-sided cylindrical structure 18. Operationally, it can be considered that the full height of the outer cylindrical surface (e.g., structure 18 plus vertical sections 34) is employed for radiation, with vertical currents excited at each radiating element position thereby increasing or maximizing the radiation bandwidth.

In this configuration, the radiator portion 40 may be considered to function as a tuned loop element which is represented by the edge portions of the vertical and horizontal parts 34 and 30 of the radiator portion. With reference to FIG. 2, it will be seen that such edge portions extend from periphery 16 upward along the left side of section 34, inward along the left side of portion 30 toward axis 14, across the inward edge of portion 30 to and along the right side thereof and then downward along the right edge of section 34 to periphery 16. The conductive path comprising these edge sections may be considered to function as a resonant loop radiator at the GPS frequencies when appropriately tuned for resonance by the capacitance value provided via first capacitor portion 32 in this configuration. In this context, exciter portion 40 is arranged to function as a resonant exciter when appropriately tuned for resonance at such frequencies by the capacitance value provided via second capacitor portion 42. The result is a double tuned characteristic contributing to the impedance locus values represented in FIG. 6. A variety of other radiating element designs or variations may be provided by skilled persons once having an understanding of the invention. The term "nominally" as used herein is defined as a value or relationship which is within plus or minus 15 degrees or 15 percent of a stated value or relationship.

Figures 4, 5:
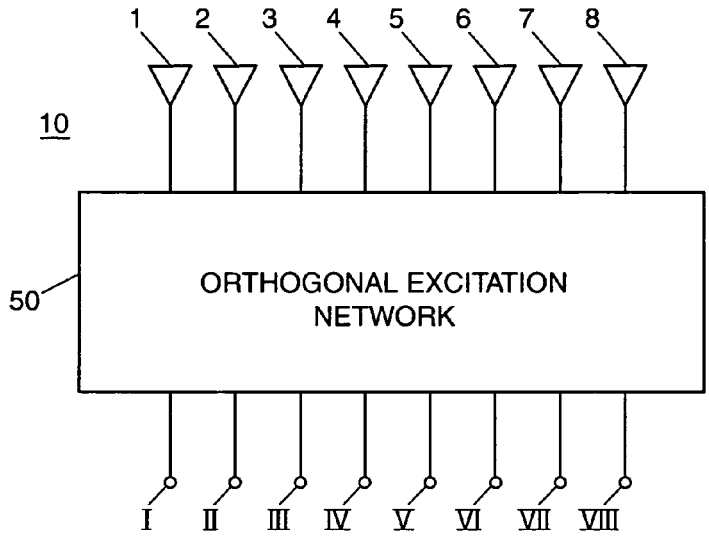
FIG. 4 is a block diagram representation of the FIG. 1 antenna showing an orthogonal excitation network as may be positioned within the lower part of the antenna.
FIG. 5 is a table showing relative phase excitation at each radiating element of the FIG. 1 antenna for each of eight excitation modes.

As already noted, antenna 10 of FIG. 1 includes an excitation network (e.g., a Butler type beam forming network) located below ground plane portion 12 and coupled to the radiating elements 1-8. FIG. 4 is a block diagram representation of the excitation network, shown as orthogonal excitation network 50, coupled to the radiating elements. In this arrangement, network 50 is configured to provide excitation of the following modes or beams I-VIII via the correspondingly labeled ports I-VIII as included in FIG. 4.

(i) Mode I: 45 degree counter-clockwise (CCW) progressive phase excitation of the radiating elements to produce a first circularly-polarized omnidirectional antenna pattern.

(ii) Mode II: 45 degree clockwise (CW) progressive phase excitation of the radiating elements to produce a second circularly polarized omnidirectional antenna pattern.

(iii) Mode III: 90 degree CCW progressive phase (PP) excitation of the radiating elements to produce a 90 degree CCW PP antenna pattern.

(iv) Mode IV: 90 degree CW progressive phase excitation of the radiating elements to produce a 90 degree CW PP antenna pattern of omnidirectional form.

(v) Mode V: 135 degree CCW progressive phase excitation of the radiating elements to produce a 135 degree CCW PP antenna pattern of omnidirectional form.

(vi) Mode VI: 135 degree CW progressive phase excitation of the radiating elements to produce a 135 degree CW PP antenna pattern of omnidirectional form.

(vii) Mode VII: 180 degree progressive phase excitation of the radiating elements to produce an eight-lobe antenna pattern.

(viii) Mode VIII: same phase excitation of the radiating elements to produce a uniform phase omnidirectional antenna pattern.

As to mode I, for example, the above characterization indicates that the eight radiating elements are excited by equal amplitude signals with the phase of signals at each successive one of elements 1-8 having a relationship of −45 degrees relative to signals at the preceding element. It will be appreciated that antenna components generally provide reciprocal performance, so that while an antenna may be intended for reception of signals, description may be in terms of element excitation by the excitation network. Thus, during reception of GPS signals, output signals representative of the antenna pattern of mode I will be provided at port I. In other configurations pursuant to the invention, other excitation modes, different combinations of modes or fewer modes may be utilized.

Excitation network 50 is effective to provide eight modes each characterized by orthogonal excitation and low mutual coupling properties relative to the other modes. Known types of Butler beam forming networks provide such properties and, using established techniques, may be designed to combine GPS signals received by the eight elements 1-8 to provide the desired mode output signals at ports I-VIII as set out above. FIG. 5 provides the relative phase excitation at each of radiating elements 1-8 as appropriate to provide the mode I-VIII outputs at the respective ports I-VIII of FIG. 4. A basic form of Butler network providing eight orthogonal fan type beams is shown and described at page 261 of *Microwave*

*Scanning Antennas*, R. C. Hansen, Academic Press, NY, 1966. With an understanding of the invention, excitation network 50 providing the element excitations as set out in FIG. 5 can be provided by skilled persons with application of current antenna design techniques.

Figures 6, 7:
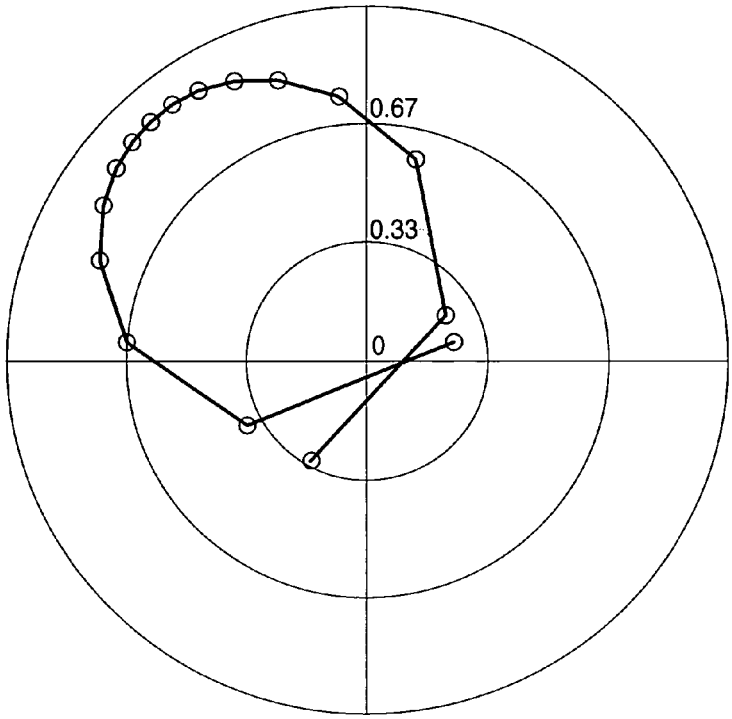
FIG. 6 is an impedance locus chart for a reference mode of the FIG. 1 antenna.
FIG. 7 is a table listing computer generated realized gain values for various excitation modes

FIG. 6 shows a computer generated impedance locus for the FIG. 1 antenna for mode I, which may be considered to be the reference mode for general reception of GPS signals.

FIG. 7 is a table listing realized gain values (basic antenna gain less applicable reflection loss) as computed for an elevation angle of 0° at frequencies of both 1228 and 1575 MHz for: modes I and II, listed as Ref. (45°); mode VIII, listed as UPO (0°); modes III and IV, listed as 90°; and modes V and VI, listed as 135°. These values are with respect to right-hand circular polarization.

Figure 8:
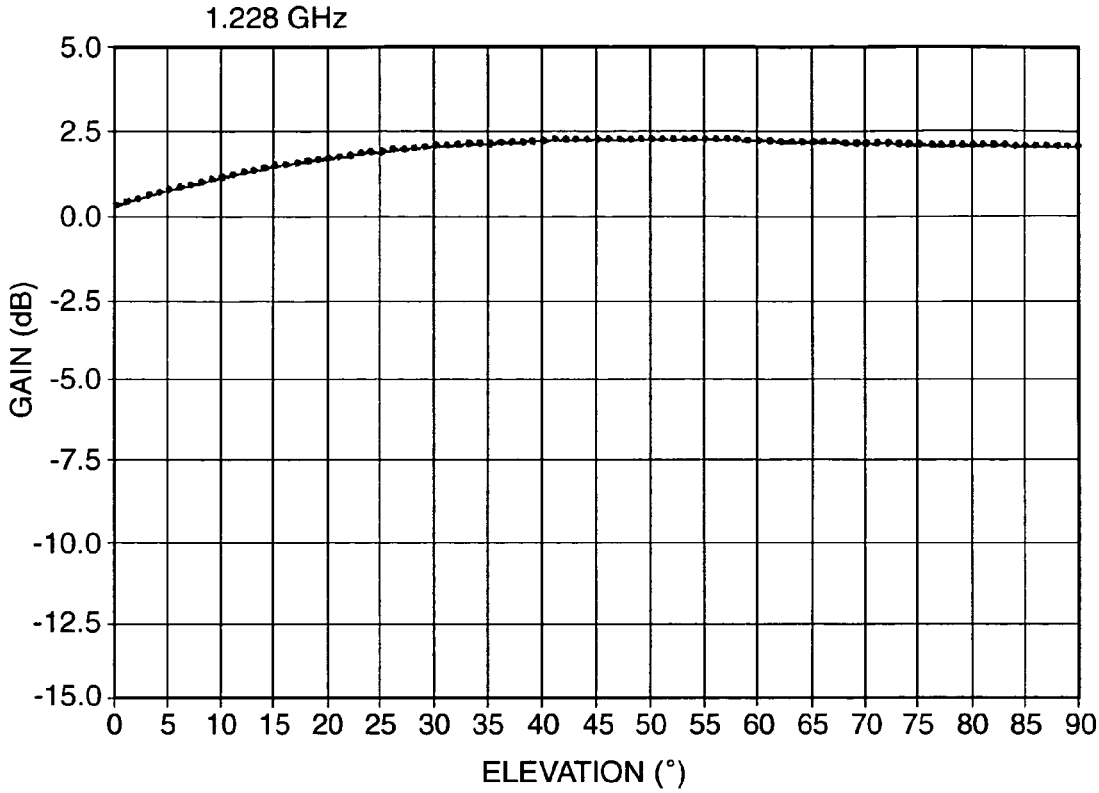
FIGS. 8, 9, 10, 11, 12, 13, 14 and 15 show computed realized elevation gain patterns for representative excitation modes of the FIG. 1 antenna.
Figure 9:
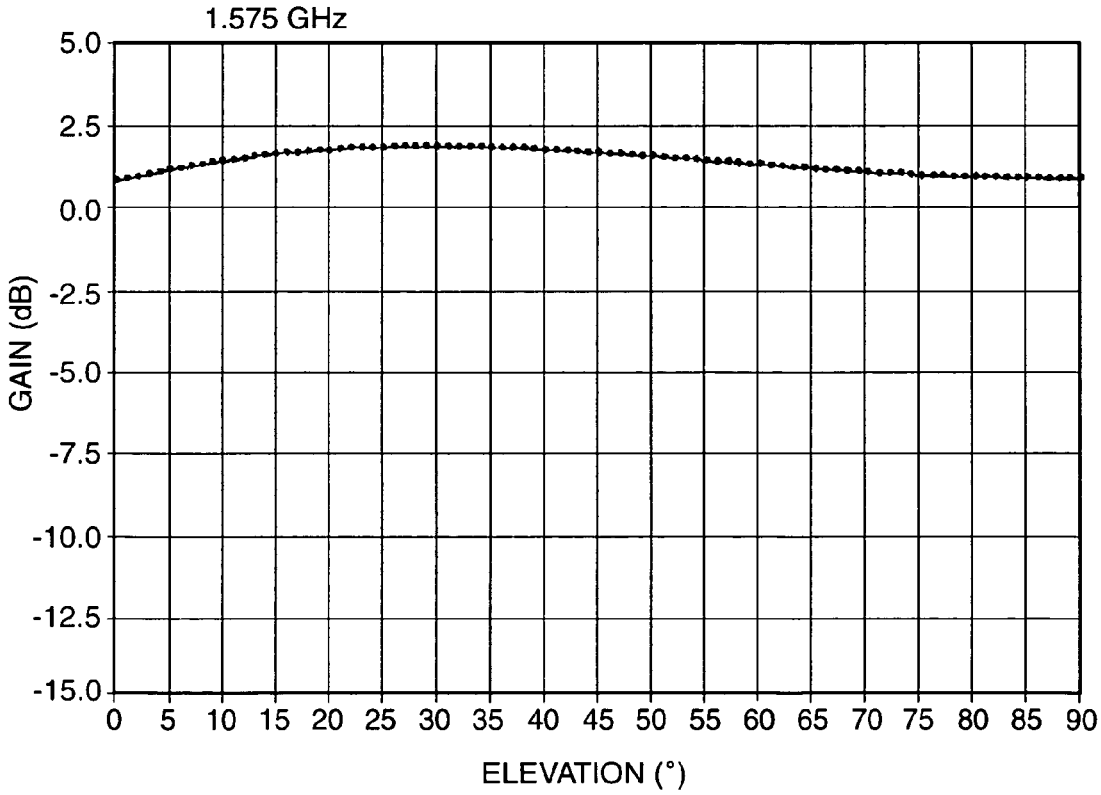
Figure 10:
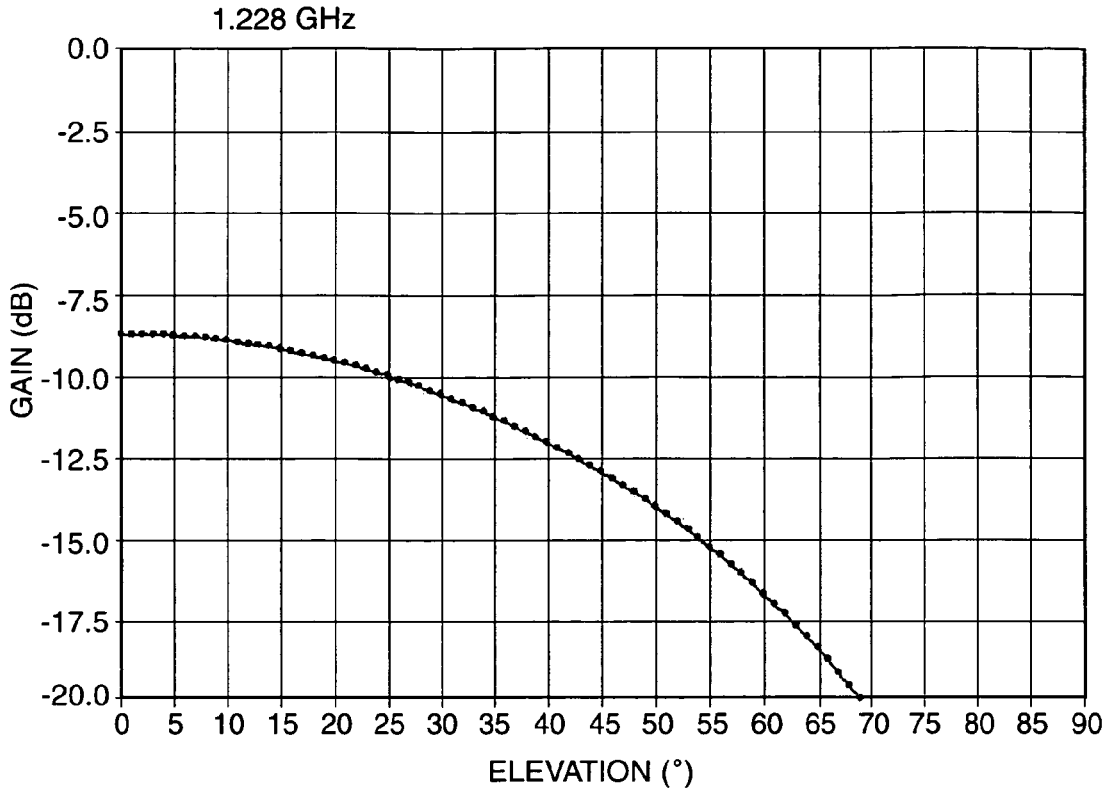
Figure 11:
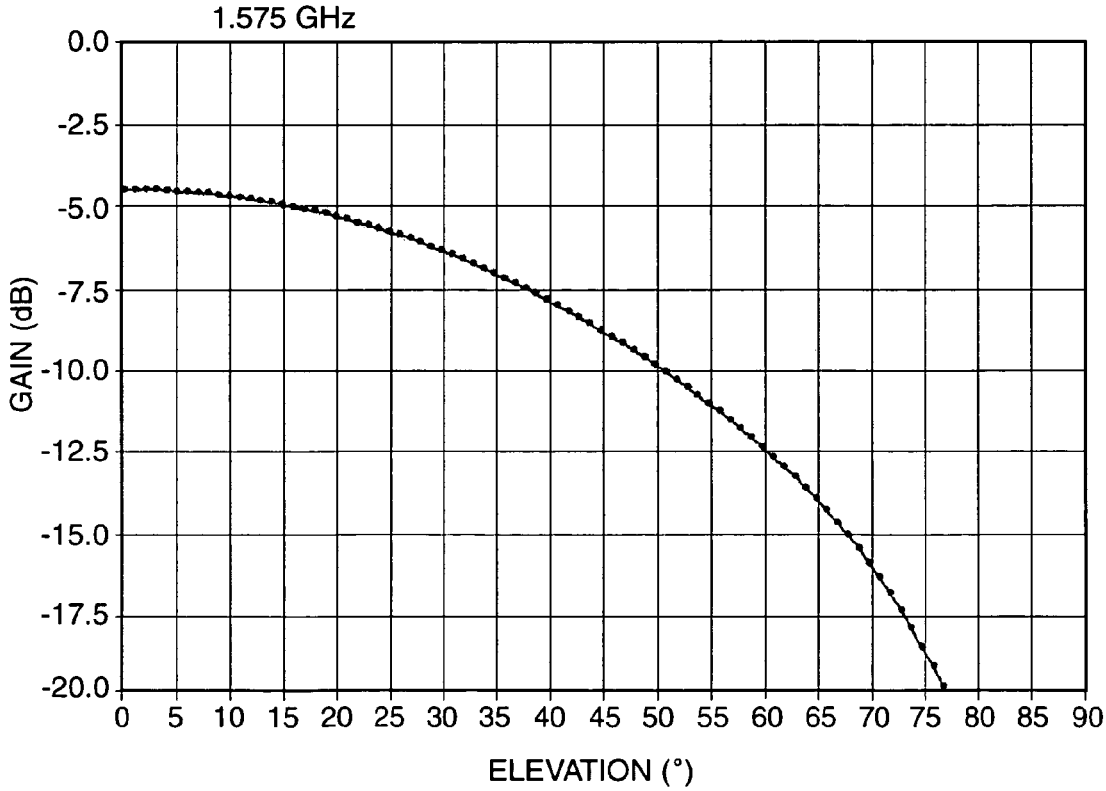
Figure 12:
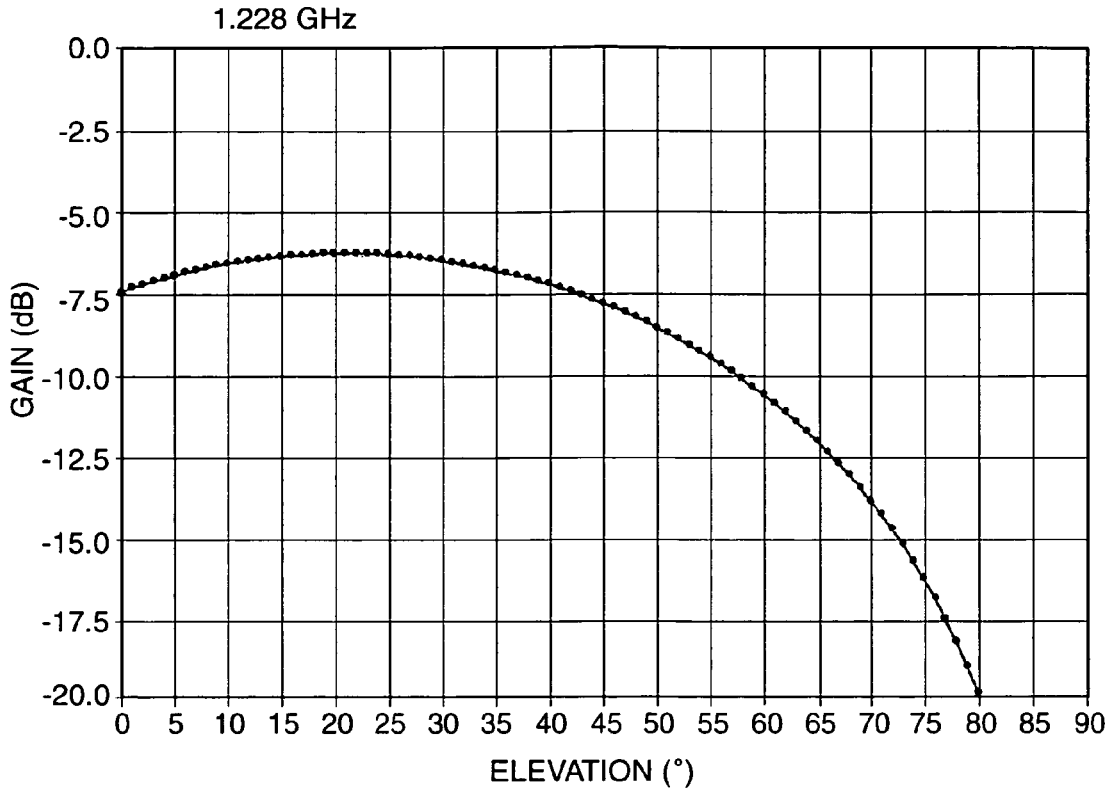
Figure 13:
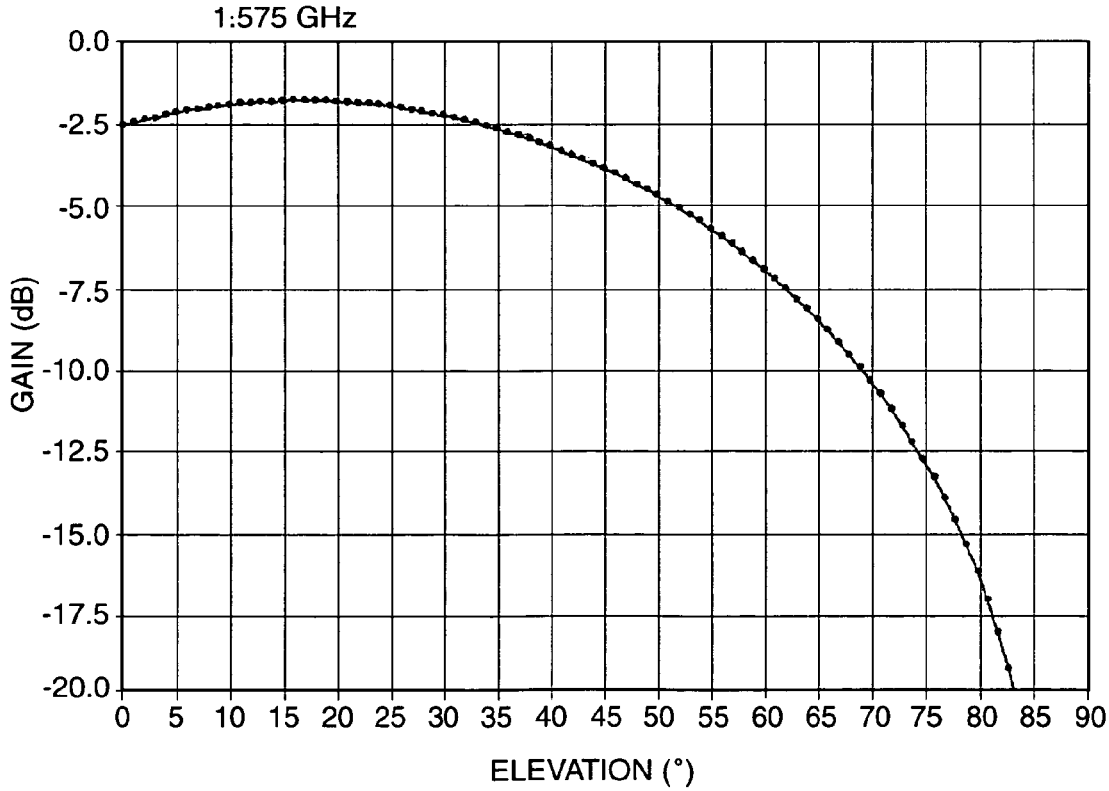
Figure 14:
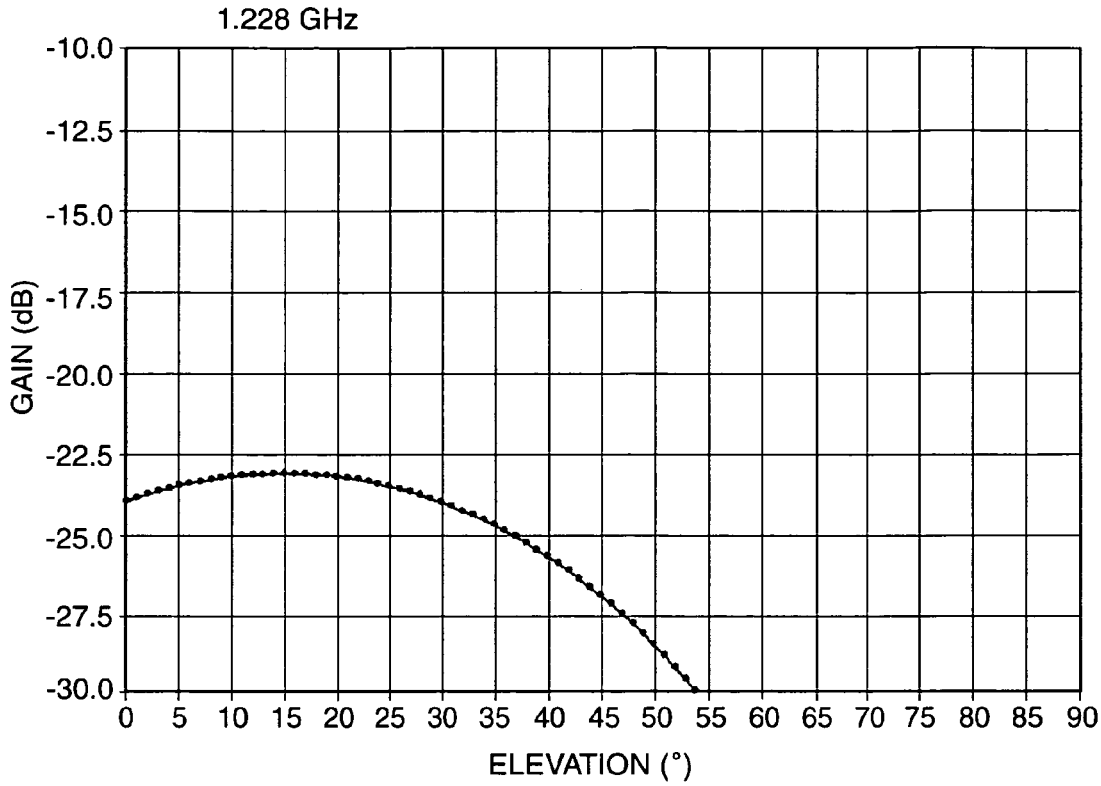

FIGS. 8-15 present representative computed realized elevation gain patterns for the FIG. 1 antenna for the following modes:

FIG. 8, modes I and II at 1228 MHz;

FIG. 9, modes I and II at 1575 MHz;

FIG. 10, mode VIII at 1228 MHz;

FIG. 11, mode VIII at 1575 MHz;

FIG. 12, modes III and IV at 1228 MHz;

FIG. 13, modes III and IV at 1575 MHz;

FIG. 14, modes V and VI at 1228 MHz; and

Figure 15:
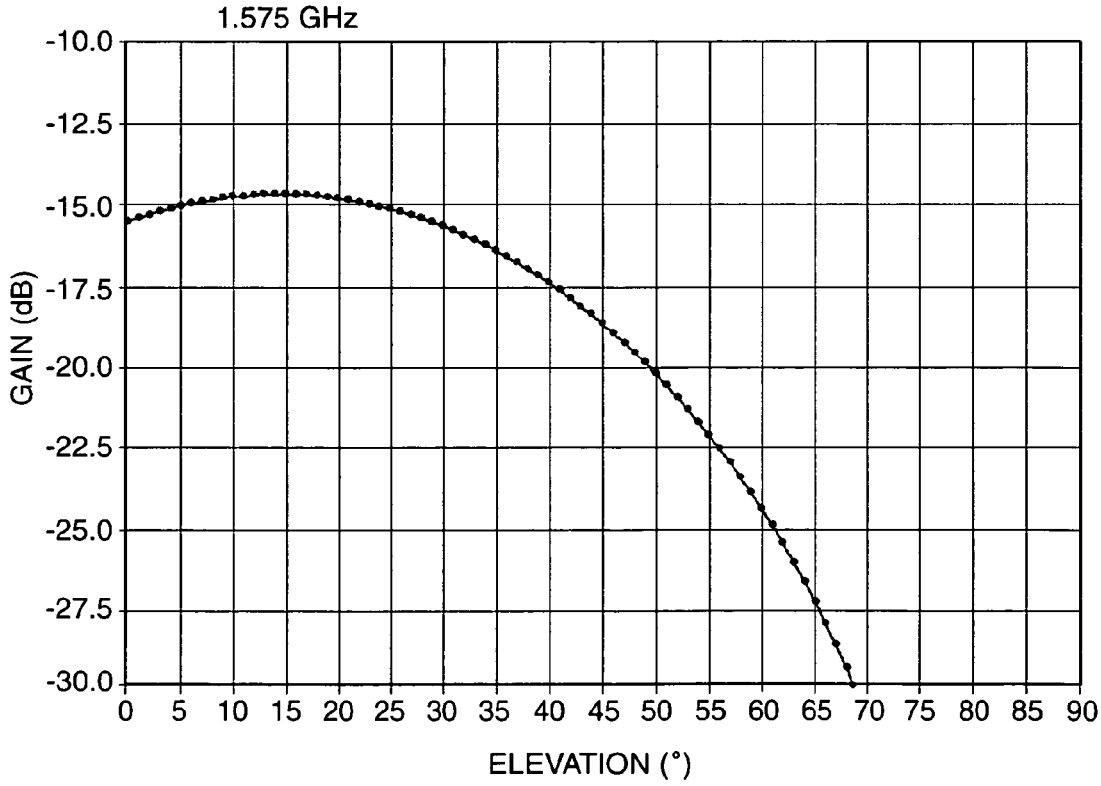

FIG. 15, modes V and VI at 1575 MHz.

Operationally, the array of radiating elements of FIG. 1 make possible an antenna of small size with desired radiation characteristics and patterns, including exceptional bandwidth characteristics. Thus, in mode I, for example, the right-hand circularly polarized (RHCP) antenna pattern provides omnidirectional coverage in azimuth, as well as vertical radiation characteristics of a hemispherical antenna pattern with elevation coverage from horizontal to vertical (0 to 90 degrees in elevation). The antenna alignment for hemispherical coverage as stated relates to FIG. 1 with axis 14 vertical, however, in use the antenna may be employed with any suitable fixed alignment or with alignment varying during flight.

With availability of the eight antenna patterns as described, the RCHP omni pattern (mode I) can be utilized as the primary antenna pattern for reception of GPS signals. This pattern provides hemispherical elevation coverage with omnidirectional coverage in azimuth, as noted. Some or all of the remaining seven antenna patterns, the auxiliary patterns in this example, may be employed pursuant to known techniques of adaptive processing to actively combine one or more of such patterns with the primary RHCP pattern in order to form, orient and steer reduced-gain antenna pattern notches or nulls to suppress signal reception in the direction of interference and jamming signals. Using such multi-pattern adaptive processing techniques, the presence of interference and jamming signals can be constantly monitored and suppression actively implemented during flight of an airborne vehicle, for example. With the eight patterns available from the present antenna, skilled persons will be enabled to implement a variety of anti-jam signal processing techniques as appropriate to particular implementations and applications of antennas employing the invention. For example, on an active continuing basis one or more reduced-gain antenna pattern nulls or notches can be steered to or provided at the fixed or changing azimuth or azimuths appropriate to suppress reception of incoming interference or jamming signals which could interfere with or prevent reliable reception of GPS signals during airborne operations.

There has been described an embodiment of an antenna of small size with capabilities of providing a mode I pattern with omnidirectional coverage, circular polarization and hemispherical coverage in elevation, which can be employed as the primary beam for airborne reception of GPS signals. And further providing capabilities to provide anti-jam operation by use of any one or more of the remaining seven antenna patterns as auxiliary beams in combinations to provide notches or nulls when and where needed, via application of adaptive processing techniques. With these size and operational characteristics, antennas pursuant to the invention may, for example, be employed in a direct solution to the problem initially described regarding the absence of anti-jam capability in military aircraft relying upon use of a FRPA (fixed radiation pattern antenna) for GPS reception purposes. Thus, there has been described a type of CRPA (controlled radiation pattern antenna) of size and capabilities such that it may relatively simply be used as a replacement antenna compatible with the volume requirements of an existing FRPA, while providing comparable or better performance, plus the addition of anti-jam capabilities.

While there have been described the currently preferred embodiments of the invention, those skilled in the art will recognize that other and further modifications may be made without departing from the invention and it is intended to claim all modifications and variations as fall within the scope of the invention.

The invention claimed is:

1. A GPS antenna, usable for anti-jam operation, comprising;

a ground plane portion having a central axis and an outer periphery;

an excitation network;

a plurality of radiating elements arrayed around said central axis, each said radiating element comprising:

a radiator portion extending above said ground plane portion from an outer location above said periphery toward said central axis and including a section conductively attached to and extending nominally perpendicularly to said ground plane portion upward from said periphery to said outer location;

a first capacitor portion capacitively coupled to said radiator portion and conductively coupled to said ground plane portion;

an exciter portion extending below said radiator portion from a position above said periphery toward said central axis and coupled to said excitation network; and a second capacitor portion capacitively coupled to said exciter portion and conductively coupled to said ground plane section; and a central disk centered at said central axis, extending above said ground plane portion toward said first capacitor portion and conductively coupled to said ground plane portion.

2. A GPS antenna as in claim 1, wherein said first capacitor portion is configured to provide impedance matching of said radiator portion.

3. A GPS antenna as in claim 2, wherein said second capacitor portion is configured to provide impedance matching of said exciter portion.

4. A GPS antenna as in claim 1, wherein said antenna includes eight said radiating elements.

5. A GPS antenna as in claim 1, wherein said excitation network is a Butler type beam forming network located below the ground plane portion.

6. A GPS antenna as in claim 1, wherein the excitation network is configured to provide output signals representative of each of the following antenna patterns;

(i) 45 degree counter-clockwise (CCW) progressive phase excitation of the radiating elements to produce a first circularly-polarized omnidirectional antenna pattern;

(ii) 45 degree clockwise (CW) progressive phase excitation of the radiating elements to produce a second circularly polarized omnidirectional antenna pattern;

(iii) 90 degree CCW progressive phase (PP) excitation of the radiating elements to produce a 90 degree CCW PP antenna pattern;

(iv) 90 degree CW progressive phase excitation of the radiating elements to produce a 90 degree CW PP antenna pattern;

(v) 135 degree CCW progressive phase excitation of the radiating elements to produce a 135 degree CCW PP antenna pattern;

(vi) 135 degree CW progressive phase excitation of the radiating elements to produce a 135 degree CW PP antenna pattern;

(vii) 180 degree progressive phase excitation of the radiating elements to produce an eight-lobe antenna pattern; and (viii) same phase excitation of the radiating elements to produce a uniform phase omnidirectional antenna pattern.

7. A GPS antenna as in claim 6, wherein said excitation network is configured to provide signals representative of each of said antenna patterns upon reception of GPS signals.

8. A GPS antenna as in claim 1, wherein the excitation network is configured to make available output signals representative of:

excitation of all said radiating elements to produce at least one primary antenna pattern for GPS reception; and a plurality of auxiliary antenna patterns usable with adaptive processing to provide anti-jam GPS operation, each said auxiliary antenna pattern having at least one pattern characteristic differing from each said primary antenna pattern and each other auxiliary antenna pattern.

9. A GPS antenna, usable for anti-jam operation, comprising:

a ground plane portion having a central axis and an outer periphery;

an excitation network; and a plurality of radiating elements arrayed around said central axis, each said radiating element comprising:

a radiator portion extending above said ground plane portion from an outer location above said periphery toward said central axis and including a section conductively attached to and extending nominally perpendicularly to said ground plane portion upward from said periphery to said outer location; and an exciter portion extending below said radiator portion from a position above said periphery toward said central axis and coupled to said excitation network; and the GPS antenna additionally comprising a central disk centered at said central axis, extending above said ground plane portion toward said radiator portion and conductively coupled to said ground plane portion.

10. A GPS antenna as in claim 9, wherein each said radiating element additionally comprises:

a first capacitor portion capacitively coupled to said radiator portion, conductively coupled to said ground plane portion and configured to provide impedance matching of said radiator portion.

11. A GPS antenna as in claim 10, wherein each said radiating element additionally comprises:

a second capacitor portion capacitively coupled to said exciter portion, conductively coupled to said ground plane section and configured to provide impedance matching of said exciter portion.

12. A GPS antenna, usable for anti-jam operation, comprising:

a ground plane portion having a central axis and an outer periphery;

an excitation network; and a plurality of radiating elements arrayed around said central axis, each said radiating element comprising:

a radiator portion extending above said ground plane portion from an outer location above said periphery toward said central axis and including a section conductively attached to and extending nominally perpendicularly to said ground plane portion upward from said periphery to said outer location; and an exciter portion extending below said radiator portion from a position above said periphery toward said central axis and coupled to said excitation network;

said excitation network configured to make available output signals representative of:

excitation of all said radiating elements to produce at least one primary antenna pattern for GPS reception; and a plurality of auxiliary antenna patterns usable with adaptive processing to provide anti-jam GPS operation, each said auxiliary antenna pattern having at least one pattern characteristic differing from each said primary antenna pattern and each other auxiliary antenna pattern.

13. A GPS antenna as in claim 12, wherein each said radiating element additionally comprises:

a first capacitor portion capacitively coupled to said radiator portion, conductively coupled to said ground plane portion and configured to provide impedance matching of said radiator portion.

14. A GPS antenna as in claim 13, wherein each said radiating element additionally comprises:

a second capacitor portion capacitively coupled to said exciter portion, conductively coupled to said ground plane section and configured to provide impedance matching of said exciter portion.

* * * * *